US005113780A

United States Patent [19]

Bennett et al.

[11] Patent Number: 5,113,780

[45] Date of Patent: May 19, 1992

[54] AUTOMATIC BOAT TRIM TAB CONTROL

[75] Inventors: Blake J. Bennett, Boca Raton, Fla.; David A. Hagstrom, Endicott, N.Y.

[73] Assignee: Bennett Marine, Incorporated, Deerfield Beach, Fla.

[21] Appl. No.: 575,193

[22] Filed: Aug. 30, 1990

[51] Int. Cl.[5] ..... B63B 39/06

[52] U.S. Cl. ..... 114/286

[58] Field of Search ..... 114/285, 286, 126, 287, 114/275, 276, 291, 277, 284

[56] References Cited

U.S. PATENT DOCUMENTS

| | | | |
|---|---|---|---|
| 3,641,965 | 2/1972 | Schmiedel | 114/286 |
| 3,695,204 | 10/1972 | Bennett | 114/286 |
| 4,261,278 | 4/1981 | Gaudin | 114/286 |
| 4,762,079 | 8/1988 | Takeuchi et al. | 114/285 |

*Primary Examiner*—Jesûs D. Sotelo
*Assistant Examiner*—Stephen P. Avila
*Attorney, Agent, or Firm*—Barnes, Kisselle, Raisch, Choate, Whittemore & Hulbert

[57] ABSTRACT

A boat trim control system that includes a pair of trim tabs pivotally mounted to the stern of a boat hull, and an engine responsive to application of electrical ignition power for powering the boat through the water. A pair of fluid actuators extend between the hull and the respective trim tabs for selectively and adjustably moving the tabs between fully extended and fully retracted positions. A fluid drive is responsive to a boat operator for selectively adjusting positions of the trim tabs independently of each other to maintain a desired attitude of the boat hull. Electronic control circuitry is responsive to removal of ignition power from the engine for operating the fluid drive and energizing the actuators for a predetermined time duration so as to move boat trim tabs to the fully retracted positions upon removal of ignition power from the engine.

9 Claims, 1 Drawing Sheet

AUTOMATIC BOAT TRIM TAB CONTROL

The present invention is directed to control of trim tabs on power boats, and more particularly to automatic positioning of the trim tabs at a fully retracted position upon removal of ignition power from the boat engine.

BACKGROUND AND OBJECTS OF THE INVENTION

Devices are conventionally employed on power boats for selectively adjusting or trimming boat attitude under varying load and sea conditions as the boat is powered through the water. For example, U.S. Pat. No. 3,695,204 discloses a trim control system in which a pair of trim tabs are pivotally mounted at laterally spaced positions on the boat stern. A pair of hydraulic fluid actuators extend between the boat hull and the respective trim tabs, and are connected to a valve and pump system coupled to an operator control for selectively adjusting positions of the respective trim tabs independently of each other. Other attitude trim control devices are known in the art.

Although the trim control system disclosed in the above-noted patent has enjoyed substantial commercial acceptance and success, improvements remain desirable. For example, when the engine is shut down, the trim tabs remain in the positions last selected by the operator. When the engine is restarted for powering the boat, the operator may not be aware of the positions of the trim tabs. Further, if the trim tabs and actuators remain extended, hydraulic pressure is maintained in the trim tab actuators during non-use, and unnecessary marine growth may occur on the actuating cylinders. There is also a risk of damage to the trim tabs from fork lifts, trailers and dry storage racks.

A general object of the present invention, therefore, is to provide a trim tab control system that includes facility for automatically returning the trim tabs to the fully retracted positions when engine operation is terminated. Another and more specific object of the present invention is to provide a trim tab control system of the described character that can be installed in the aftermarket on existing power boats by relatively unskilled personnel.

SUMMARY OF THE INVENTION

A power boat trim control system in accordance with the present invention includes a boat having a hull and an engine for powering the boat through the water. At least one device such as a trim tab is movably mounted to the hull for trimming attitude of the boat as the hull is propelled through the water. The trim tab is selectively adjustable by an operator to maintain desired boat attitude under varying load and sea conditions. Electronic control circuitry is coupled to the trim tab and to the engine for automatically moving the trim tab to a predetermined position—e.g., a fully retracted position—upon removal of power from the engine.

In the preferred embodiment of the invention, the trim control mechanism comprises a pair of trim tabs pivotally mounted to the hull at laterally spaced positions on the stern. A pair of fluid actuators extend between the hull and the respective trim tabs for selectively moving each tab to any desired position between a fully extended and a fully retracted position. A fluid drive is responsive to the boat operator for selectively adjusting positions of the trim tabs independently of each other to maintain a desired attitude of the boat hull. The electronic control circuit is coupled to the fluid drive and is responsive to removal of electrical ignition power from the engine for operating both actuators simultaneously for a predetermined time duration so as to move both trim tabs to the fully retracted positions upon removal of ignition power from the engine.

The boat trim tabs are thus returned to the fully retracted positions each time power is removed from the engine. In this way, the boat operator will be aware of initial trim tab position each time power is applied to the engine even when the boat is not equipped trim tab position indicating devices. With the trim tabs and actuators fully retracted, the actuators are not subjected to hydraulic fluid pressure during storage, and marine growth on the actuators is reduced. Also reduced is the likelihood of damage to one or both of the trim tabs during storage and/or transport of the boat.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENT

Figure 1:
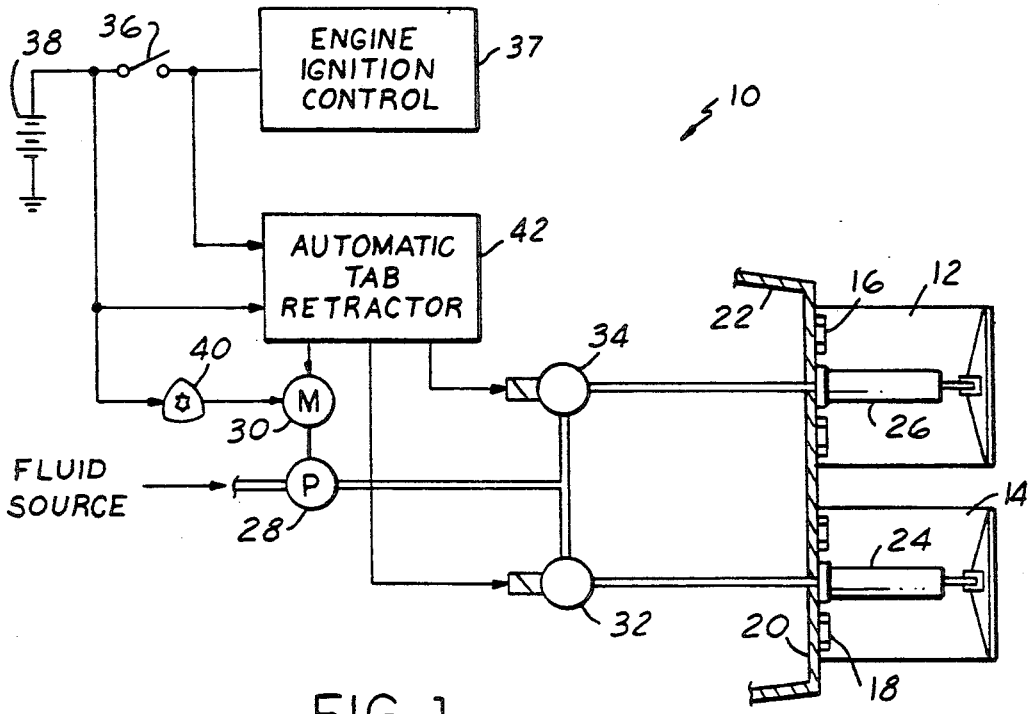
FIG. 1 is a functional block diagram of a power boat trim control system in accordance with a presently preferred embodiment of the invention.

FIG. 1 illustrates a power boat trim control system 10 in accordance with a presently preferred embodiment of the invention as comprising a pair of trim tabs 12,14 pivotally mounted by respective hinges 16,18 on the stern 20 of a boat hull 22. A pair of hydraulic actuators 24,26 are respectively mounted on stern 20 and have actuator rods that extend to trim tabs 12,14. A fluid pump 28 is powered by an electrical motor 30 for supplying hydraulic fluid under pressure from a fluid source to actuators 24,26 through respective solenoid-operated flow control valves 32,34. An ignition key switch 36 selectively connects the ignition control system 37 of the boat engine to a source of electrical power, such as a battery 38. An operator switch 40 is coupled to battery 38 for selectively applying electrical control signals to motor 30 and valves 32,34 for adjusting position of trim tabs 12,14 independently of each other. To the extent thus far described, system 10 is of conventional construction, with the electrohydraulic trim tab control being disclosed in detail in above-noted U.S. Pat. No. 3,695,204.

Figure 2:
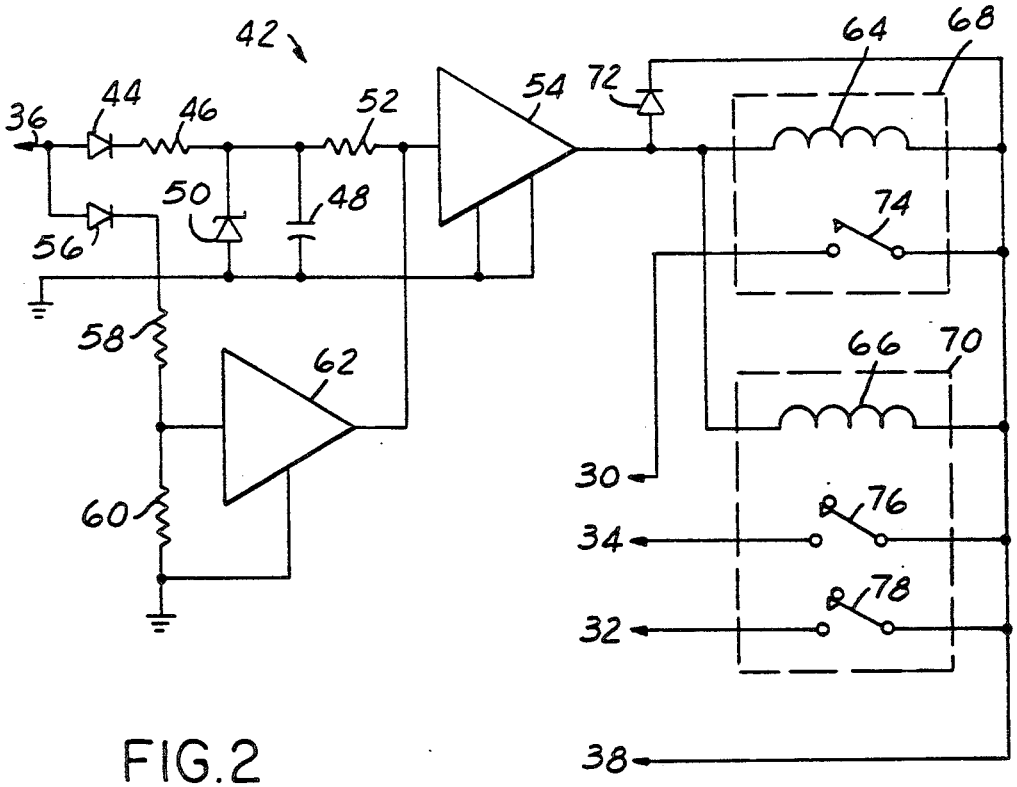
FIG. 2 is an electrical schematic diagram of the automatic tab retraction module in the functional block diagram of FIG. 1.

In accordance with the present invention, an electronic control circuit 42 (FIGS. 1 and 2) is connected to motor 30 and valves 32,34 for automatically retracting actuators 24,26 and tabs 12,14 upon removal of ignition power from engine ignition control 37. More specifically, the power input to engine ignition control 37, on the normally open side of switch 36, is connected within automatic tab retractor circuit 42 through a diode 44 and a resistor 46 across an energy storage capacitor 48. A zener diode 50 is connected across capacitor 48 for limiting the voltage stored thereon. Capacitor 48 is connected through a resistor 52 to the input of an amplifier 54. The normally open contact of switch 36 is also connected through a diode 56 and a voltage divider 58,60 to the input of a second amplifier 62. Amplifiers 54 and 62 may be Darlington switches.

The output of amplifier 54 is connected through the coils 64,66 of a pair of electronic relays 68,70 to battery 38 at the common contact of switch 36 (FIG. 1), so that power is applied to relays 68,70 independently of switch 36. A diode 72 is connected across coils 64,66 for limiting voltage spikes. Relay 68 has a normally open contact set 74 responsive to current through coil 64 for connecting motor 30 to power source 38 independently of switch 40. Likewise, relay 70 has a pair of normally open contact sets 76,78 responsive to current through coil 66 for connecting solenoid valves 32,34 to battery 38 independently of switch 40.

In operation, with ignition switch 36 closed and ignition power thus applied to control circuit 37, power is likewise supplied to automatic tab retractor circuit 42, so that the input to amplifier 62 is high and voltage is stored at substantially battery potential on capacitor 48. The output of amplifier 62 is at a low voltage state, so as to inhibit operation of amplifier 54 independently of potential across capacitor 48. The output of amplifier 54 is therefore at a high voltage level, and no current is conducted through relay coils 64,66. Operation of motor 30 and valves 32,34 is thus controlled by switch 40 during normal boat operation.

When ignition switch 36 is opened so as to remove power from control circuit 37, the input to amplifier 62 switches to a low voltage potential, and the output thereof switches to a high or open circuit condition. Amplifier 62 thus no longer inhibits operation of amplifier 54. Capacitor 48 therefore raises the input of amplifier 54 to a high voltage state, and discharges through resistor 52 into the input of amplifier 54 for a predetermined time duration corresponding to the values of capacitor 48 and resistor 52. During this capacitor discharge time, the output of amplifier 54 assumes a low voltage state and draws current through coils 64,66 of relays 68,70, closing relay contact sets 74,76 and 78, and applying power through the relay contacts to pump motor 30 and valves 32,34. The time duration of discharge of capacitor 48 through resistor 52 and amplifier 54 is selected to be sufficient to return both trim tabs 12,14 simultaneously to the fully retracted positions independently of the positions at which the trim tab had been set during normal operation.

Thus, upon opening of switch 36, both trim tabs 12,14 and actuators 24,26 are moved to the fully retracted positions. When power is again applied to the ignition control circuitry, the trim tab positions may again be selectively adjusted by the operator through switch 40. It will be appreciated, of course, that the principles of the invention apply to electrical or pneumatic actuators of trim tabs, in addition to the preferred hydraulic implementation. The invention may be employed in conjunction with any number of trim tabs on a given boat. The predetermined actuation time of amplifier 62, determined by capacitor 48 and resistor 52, varies with the number of trim tabs and cylinders. For example, a fifteen second duration would be appropriate for two tabs and one actuator per tab, whereas a duration of twenty-two to twenty-five seconds would be appropriate for a boat having two tabs and two actuators per tab.

We claim:

1. A boat trim control system that comprises:

a boat having a hull and an engine for powering said boat, means for selectively applying electrical power to said engine for powering the boat, means movably mounted to said hull for trimming attitude of said boat as said hull is propelled through the water, means carried by said hull and responsive to a boat operator for selectively adjusting position of said trimming means to maintain desired attitude under varying conditions, and means coupled to said trimming means and to said engine, and responsive to removal of electrical power from said engine, for automatically moving said trimming means to a predetermined position with respect to said hull upon removal of power at said engine.

2. The system set forth in claim 1 wherein said means response to removal of electrical power comprises means for sensing removal of electrical ignition energy from said engine to move said trimming means to said predetermined position.

3. The system set forth in claim 1 wherein said selectively-positioning means comprises actuator means extending between said hull and said trimming means for moving said trimming means toward and away from said predetermined position, and wherein said automatically-moving means comprises means for applying power to said actuator means for a predetermined time duration following removal of power at said engine sufficient to move said trimming means to said predetermined position independently of position of said trimming means when power is removed from said engine.

4. The system set forth in claim 3 wherein said actuator means comprises a fluid actuator, said selectively-positioning means comprising a pump and a valve for selectively applying fluid under pressure to extend and retract said actuator, said automatically-positioning means comprising means for operating said pump and valve so as to move said actuator and trimming means to a fully retracted position.

5. The system set forth in claim 4 wherein said attitude-trimming means comprises a pair of laterally spaced trim tabs pivotally mounted to said hull, said selectively-positioning means comprising a pair of said actuators respectively coupled to said trim tabs, a pump and a pair of said valves for selectively extending and retracting said actuators independently of each other, and wherein said automatically-positioning means comprises means for operating said motor and valves simultaneously to move said actuators and trim tabs to said fully retracted position.

6. The system set forth in claim 3 wherein said means responsive to removal of electrical power comprises means for sensing removal of electrical ignition energy from said engine to move said trimming means to said predetermined position.

7. The system set forth in claim 6 wherein said automatically-moving means comprises an electronic switch connected between said source of electrical power and said actuator means, and means for closing said switch for said predetermined time duration upon removal of ignition power from said engine.

8. The system set forth in claim 7 wherein said switch-closing means comprises electrical energy storage means, means for storing electrical energy on said storage means as long as ignition power is supplied to said engine, and means for discharging said energy storage means over said predetermined time duration upon removal of ignition energy from said engine.

9. A boat trim control system that comprises:

a boat having a hull with a stern and an engine, at least one trim tab pivotally mounted to said hull at said stern, an actuator extending between said hull and said tab for selectively moving said tab between fully extended and retracted positions, means including a drive responsive to an operator for selectively adjusting position of said trim tab to obtain a desired attitude of said hull, means for selectively applying electrical ignition power to said engine for powering said boat, and means coupled to said drive and responsive to removal of electrical power from said engine for operating said actuator for a predetermined time duration so as to move said trim tab to said fully retracted position upon removal of ignition power from said engine.

* * * * *